US005500666A

United States Patent [19]

Hattori et al.

[11] Patent Number: 5,500,666

[45] Date of Patent: Mar. 19, 1996

[54] CAPPING MEMBER FOR INDIRECTLY VENTING THE INTERIOR OF AN INK CONTAINER, AND RECORDING CARTRIDGE AND APPARATUS USING SAME

[75] Inventors: Yoshifumi Hattori, Yamato; Seiichiro Karita, Yokohama; Hideo Saikawa, Kawasaki; Toshio Kashino, Chigasaki; Akio Saito, Hadano; Hiroshi Nakagomi, Yamato; Teruo Arashima, Yokohama; Makiko Kimura, Sagamihara; Hiroshi Sugitani, Machida; Masami Ikeda, Tokyo; Asao Saito, Yokohama; Kazuaki Masuda, Sagamihara; Tsuyoshi Orikasa, Kasukabe, all of Japan

[73] Assignee: Canon Kabushiki Kaisha, Tokyo, Japan

[21] Appl. No.: 288,216

[22] Filed: Aug. 9, 1994

Related U.S. Application Data

[63] Continuation of Ser. No. 963,530, Oct. 20, 1992, abandoned, which is a continuation of Ser. No. 583,340, Sep. 17, 1990, abandoned.

[30] Foreign Application Priority Data

| | | | |
|---|---|---|---|
| Sep. 18, 1989 | [JP] | Japan | 1-241042 |
| Aug. 3, 1990 | [JP] | Japan | 2-206592 |

[51] Int. Cl.[6] ..... B41J 2/175

[52] U.S. Cl. ..... 347/87

[58] Field of Search ..... 347/86, 87

[56] References Cited

U.S. PATENT DOCUMENTS

| | | | |
|---|---|---|---|
| 3,953,862 | 4/1976 | Amberntsson et al. | 346/140 R |
| 4,313,124 | 1/1982 | Hara | 346/140 R |
| 4,345,262 | 8/1982 | Shirato et al. | 346/140 R |
| 4,419,678 | 12/1983 | Kasugayama et al. | 346/140 R |
| 4,429,320 | 1/1984 | Hattori et al. | 346/140 R |
| 4,459,600 | 7/1984 | Sato et al. | 346/140 R |
| 4,463,359 | 1/1984 | Ayata et al. | 346/1.1 |
| 4,491,433 | 1/1985 | Shiurila et al. | 400/471.1 |
| 4,511,906 | 4/1985 | Hara | 347/86 |
| 4,558,333 | 12/1985 | Sugitani et al. | 346/140 R |
| 4,600,927 | 7/1986 | Sugitani | 346/1.1 |
| 4,658,273 | 4/1987 | Yuki et al. | 346/140 R |
| 4,680,696 | 7/1987 | Ebinuma et al. | 346/75 |
| 4,689,642 | 8/1987 | Sugitani | 346/140 R |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,914,453 | 4/1990 | Kanayama et al. | 346/140 R |
| 4,929,969 | 5/1990 | Morris | 346/140 R |
| 4,968,998 | 11/1990 | Allen | 346/140 R |
| 5,070,347 | 12/1991 | Yuki et al. | 347/86 |

FOREIGN PATENT DOCUMENTS

| | | |
|---|---|---|
| 162516 | 2/1904 | Germany . |
| 3430460 | 7/1985 | Germany . |
| 54-056847 | 5/1979 | Japan . |
| 55-042874 | 3/1980 | Japan . |
| 59-123670 | 7/1984 | Japan . |
| 59-138461 | 8/1984 | Japan . |
| 60-071260 | 4/1985 | Japan . |

*Primary Examiner*—N. Le

*Attorney, Agent, or Firm*—Fitzpatrick, Cella, Harper & Scinto

[57] ABSTRACT

A recording head cartridge includes a recording head for ejecting recording liquid in the form of a droplet thereof; a container for containing the recording liquid; a communicating pipe for substantially balancing pressure in the container with an ambient pressure; a blocking plate disposed adjacent an inside opening of the pipe at a position away from the opening.

24 Claims, 8 Drawing Sheets

CAPPING MEMBER FOR INDIRECTLY VENTING THE INTERIOR OF AN INK CONTAINER, AND RECORDING CARTRIDGE AND APPARATUS USING SAME

This application is a continuation of application Ser. No. 07/963,530 filed Oct. 20, 1992, now abandoned, which in turn is a continuation of application Ser. No. 07/583,340 filed Sep. 17, 1990, now abandoned.

FIELD OF THE INVENTION AND RELATED ART

The present invention relates to a recording head cartridge, an ink container and an ink jet recording apparatus, particularly to a recording head cartridge comprising an ink jet recording head for ejecting recording liquid and a container for containing the recording liquid to be supplied to the recording head, wherein the ink container is provided with an air vent.

A recording head cartridge which comprises the recording head and the ink container and which is reciprocally movable on a carriage, uses a porous material in the ink container in order to prevent leakage of the ink and swinging movement of the ink (Japanese Laid-Open Patent Application No. 42874/1980). The ink container is provided with an air vent to balance the pressure in the container with the atmospheric pressure. As contrasted to the ink container with the porous material, the recording head cartridge with the porous material in the ink container, retained the ink (recording liquid), mainly in the pores of the porous material. Therefore, the recording liquid does not leak through the air vent or the ink ejection outlets.

However, when the cartridge is vibrated or dropped, the porous material can not retain the recording liquid, so that it scatters from the porous material. If the scattered liquid is deposited in the air vent opening, the recording liquid leaks out through the air vent, or the ink contaminates the apparatus. In an attempt to provide a solution to the above mentioned problems, a proposal has been in which a film which can pass only the gases, to cover the air vent, but the gas transmitting property of such a film does not last long enough.

SUMMARY OF THE INVENTION

Accordingly, it is a principal object of the present invention to provide an ink container, an ink jet recording cartridge having the same and an ink jet recording apparatus having the ink container and the cartridge, wherein the ink (recording liquid) in the container is effectively prevented from leaking out of the container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

FIGS. 2, 3, 4, 5 and 6 illustrate an ink jet unit IJU, an ink jet heat IJH, an ink container IT, an ink jet cartridge IJC, a head carriage HC and a main assembly IJRA of an ink jet recording apparatus, according to an embodiment of the present invention, and relations among them. The structure of the respective elements will be described in the following.

Figure 2:
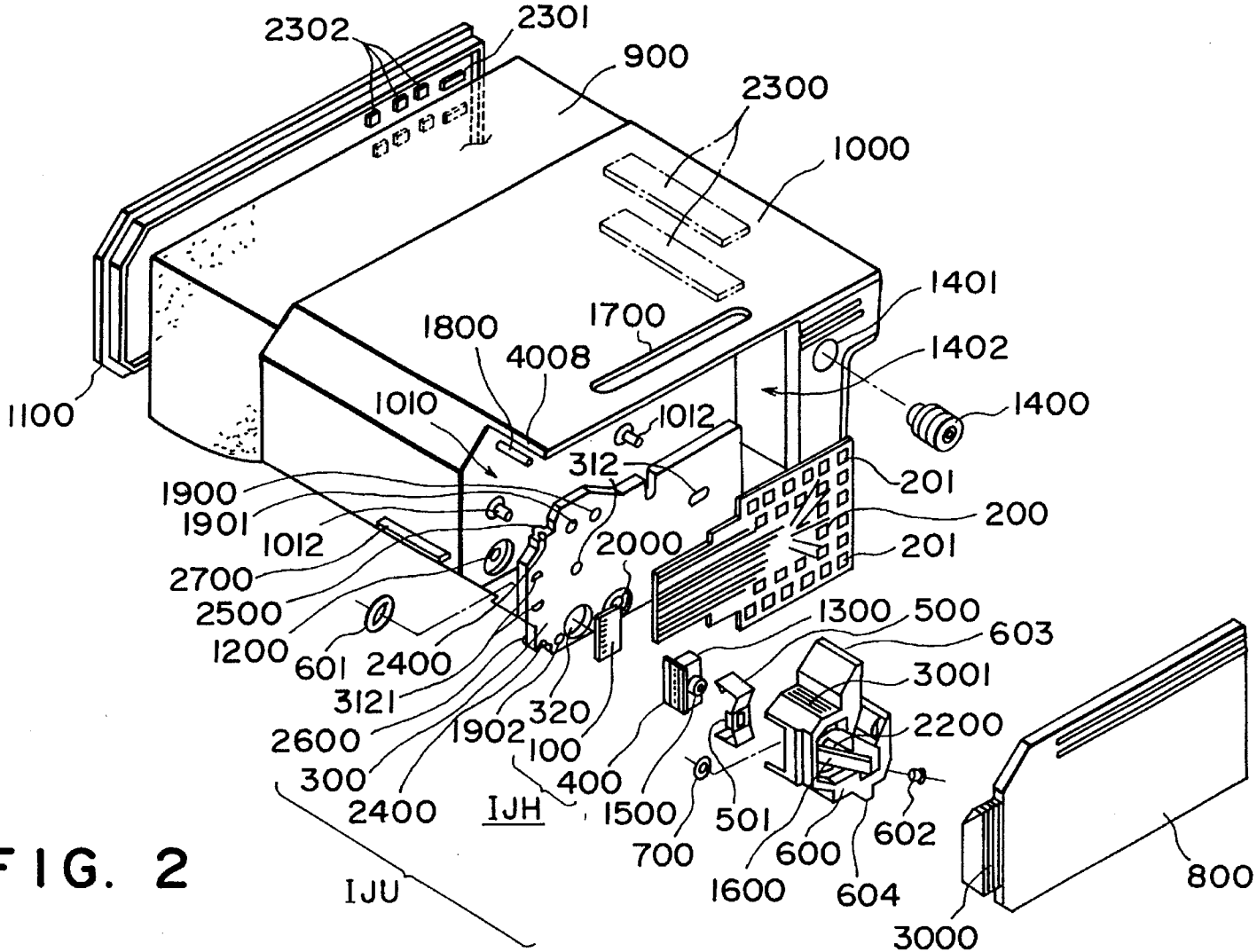
FIG. 2 is an exploded perspective view of an ink jet cartridge according to an embodiment of the present invention.
Figure 3:
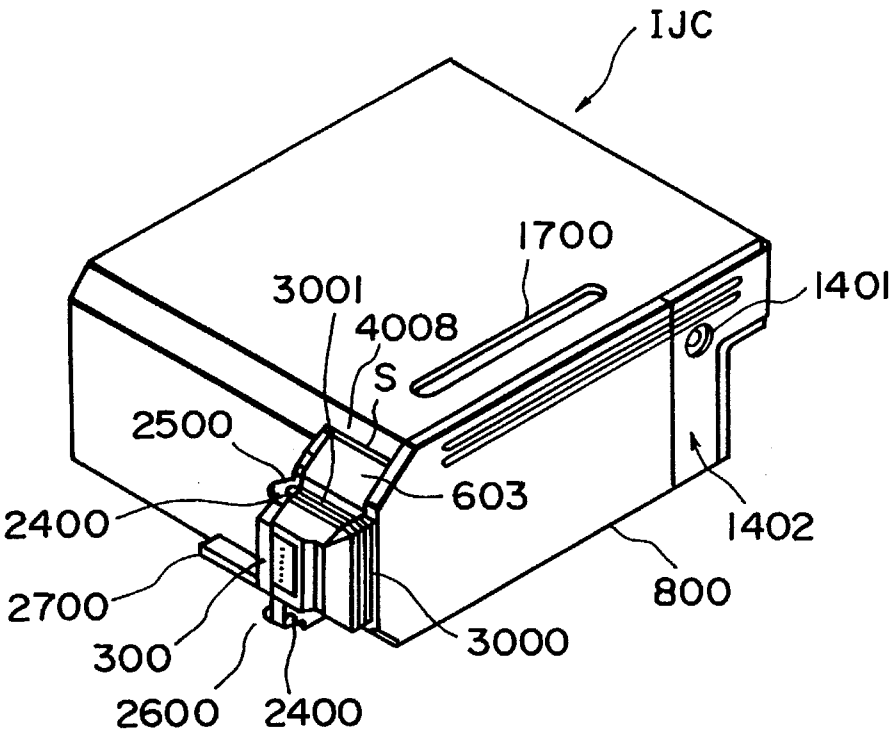
FIG. 3 is a perspective view of an outer appearance of the ink jet cartridge.

As will be understood from the perspective view of FIG. 3, the ink jet cartridge IJC in this embodiment has a relatively large ink accommodation space, and an end portion of the ink jet unit IJU is slightly projected from the front side surface of the ink container IT. The ink jet cartridge IJC is mountable at correct position on the carriage HC (FIG. 5) of the ink jet recording apparatus main assembly IJRA by proper positioning means and with electric contacts, which will be described in detail hereinafter. It is, in this embodiment, a disposable type head detachably mountable on the carriage AC. The structure disclosed in FIGS. 2–6 contain various novel features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 2, the unit comprises a heater board 100 having electrothermal transducers (ejection heaters) arranged in a line on an Si substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 100 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding to the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of "M" having a central portion urging to the common chamber with a light pressure, and a clamp 501 urges concentratedly with a line pressure to a part of the liquid passage, preferably the part in the neighborhood of the ejection outlets. The confining spring 500 has legs for clamping the heater board 100 and the top plate 1300 by penetrating through the openings 3121 of the supporting plate 300 and engaging the back surface of the supporting plate 300. Thus, the heater board 100 and the top plate 1300 are clamped by the concentrated urging force by the legs and the clamp 501 of the spring 500. The supporting plate 300 has positioning openings 312, 1900 and 2000 engageable with two positioning projections 1012 and positioning and fuse-fixing projections 1800 and 1801 of the ink container IT. It further includes projections 2500 and 2600 at its backside for the positioning relative to the carriage HC of the main assembly IJRA.

In addition, the supporting member 300 has a hole 320 through which an ink supply pipe 2200, which will be described hereinafter, is penetrated for supplying ink from the ink container. The wiring board 200 is mounted on the supporting member 300 by bonding agent or the like. The supporting member 300 is provided with recesses 2400 and 2400 adjacent the positioning projections 2500 and 2600.

Figure 5:
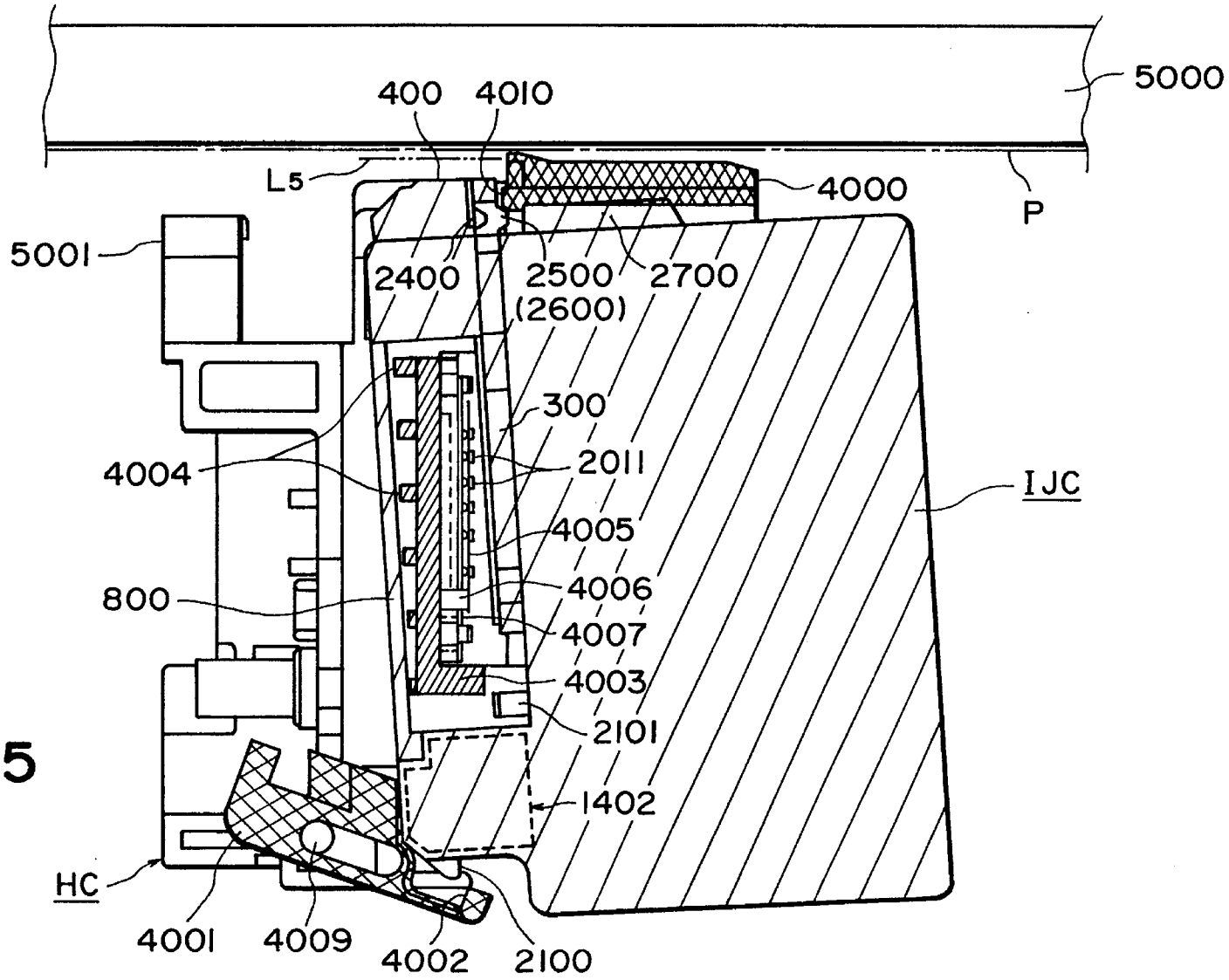
FIG. 5 is a top plan view of the ink jet cartridge to be mounted on the cartridge of the ink jet apparatus.

As shown in FIG. 3, the assembled ink jet cartridge IJC has a head projected portion having three sides provided with plural parallel grooves 3000 and 3001. The recesses 2400 and 2400 are located at extensions of the parallel grooves at the top and bottom sides to prevent the ink or foreign matter moving along the groove from reaching the projections 2500 and 2600. The covering member 800 having the parallel grooves 3000, as shown in FIG. 5, constitutes an outer casing of the ink jet cartridge IJC and cooperates with the ink container to define a space for accommodating the ink jet unit IJU. The ink supply member 600 having the parallel groove 3001 has an ink conduit pipe 1600 communicating with the above-described ink supply pipe 2200 and cantilevered at the supply pipe 2200 side. In order to assure the capillary action at the fixed side of the ink conduit pipe 1600 and the ink supply pipe 2200, a sealing pin 602 is inserted.

A gasket 601 seals the connecting portion between the ink container IT and the supply pipe 2200. A filter 700 is disposed at the container side end of the supply pipe. The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

In this embodiment, the complete communicating state can be assuredly obtained simply by flowing sealing bonding agent from the ink supply member side under the press-contact state. The ink supply member 600 may be fixed to the supporting member 300 by inserting and penetrating backside pins (not shown) of the ink supply member 600 through the openings 1901 and 1902 of the supporting member 300 and by heat-fusing the portion where the pins are projected through the backside of the supporting member 300. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 1000, an ink absorbing material and a cover member 1100. The ink absorbing material 900 is inserted into the main body 1000 from the side opposite from the unit (IJU) mounting side, and thereafter, the cover member 1100 seals the main body.

The ink absorbing material 900 is thus disposed in the main body 1000. The ink supply port 1200 functions to supply the ink to the ink jet unit IJU comprising the above-described parts 100–600, and also functions as an ink injection inlet to permit initial ink supply to the absorbing material 900 before the unit IJU is mounted to the portion 1010 of the main body.

In this embodiment, the ink may be supplied through an air vent port and this supply opening. In order to ensure good supply of ink, ribs 2300 are formed on the inside surface of the main body 1000, and ribs 2301 and 2302 are formed on the inside of the cover member 1100, which are effective to provide within the ink container an ink existing region extending continuously from the air vent port side to that corner portion of the main body which is most remote from the ink supply opening 1200. Therefore, in order to uniformly distribute the ink in good order, it is preferable that the ink is supplied through the supply opening 1200. This ink supply method is practically effective. The number of the ribs 2300 in this embodiment is four, and the ribs 2300 extend parallel to a movement direction of the carriage adjacent the rear side of the main body of the ink container, by which the absorbing material 900 is prevented from being closely contacted to the inner surface of the rear side of the main body. The ribs 2301 and 2302 are formed on the inside surface of the cover member 1100 at a position which is substantially an extension of the ribs 2300; however, as contrasted to the large rib 2300, the ribs 2301 and 2302 are small as if being divided ribs, so that the air existing space is larger with the ribs 2301 and 2302 than with the rib 2300. The ribs 2302 and 2301 are distributed on the entire area of the cover member 1100, and the area thereof is not more than one half of the total area. Because of the provisions of the ribs, the ink in the corner region of the ink absorbing material which is most remote from the supply opening 1200 can be stably and assuredly supplied to the inlet opening by capillary action. The cartridge is provided with an air vent port for communication between the inside of the cartridge with the outside air. Inside the vent port 1400, there is a water repellent material 1400 to prevent the inside ink from leaking outside through the vent port 1400.

The ink accommodating space in the ink container IT is substantially a rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 1100 to stabilize the ink supply from the ink absorbing material 900. The cube configuration is preferable from the standpoint of accommodating as much as possible ink in limited space. However, from the standpoint of using the ink with minimum an available part in the ink container, the provisions of the ribs formed on the two surfaces constituting a corner.

In this embodiment, the inside ribs 2301 and 2302 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 1200 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of cartridge exchange is minimized. Utilizing the rear space of the space used for unifying the ink jet unit IJU, a projection for the air vent port 1401. The inside of the projection is substantially vacant, and the vacant space 1402 functions to supply the air into the ink container IT uniformly in the direction of the thickness of the absorbing material. Because of these features described above, the cartridge as a whole is of better performance than the conventional cartridge. The air supply space 1402 is much larger than that in the conventional cartridge. In addition, the air vent port 1401 is at an upper position, and therefore, if the ink departs from the absorbing material for some reason or another, the air supply space 1402 can tentatively retain the ink to permit such ink to be absorbed back into the absorbing material. Therefore, the wasteful consumption of the ink can be saved.

Figure 4:
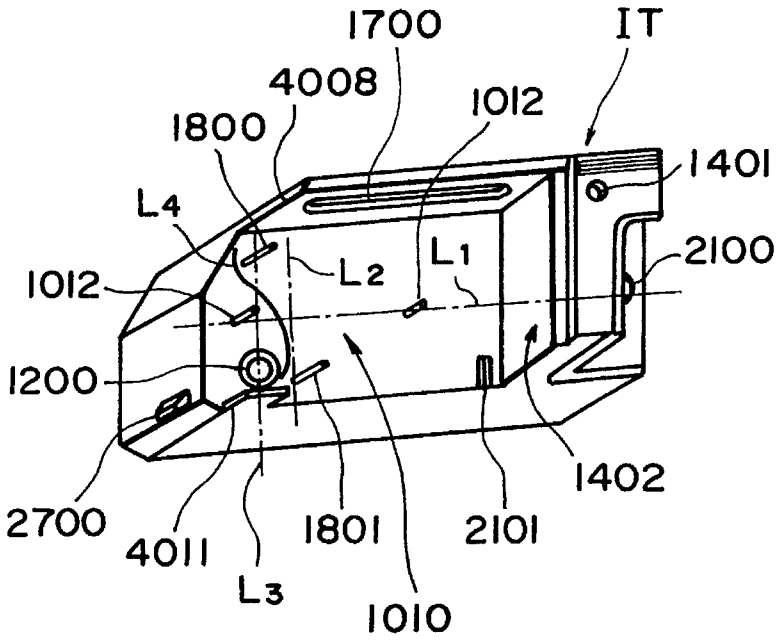
FIG. 4 is a perspective view of an outer appearance of the ink container of the ink jet cartridge as seen from the side at which the ink jet recording head is mounted.

Referring to FIG. 4, there is shown a structure of a surface of the ink container IT to which the unit IJU is mounted. Two positioning projections 1012 are on a line L1 which is a line passing through the substantial center of the array of the ejection outlets in the orifice plate 400 and parallel with the bottom surface of the ink container IT or the parallel to the ink container supporting reference surface of the carriage. The height of the projections 1012 is slightly smaller than the thickness of the supporting member 300, and the projections 1012 function to correctly position the supporting member 300. On an extension (right side) in this Figure, there is a pawl 2100 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 5.

Projections 1800 and 1801 corresponding to the fixing holes 1900 and 2000 for fixing the supporting member 300 to the side of the ink container IT, are longer than the projections 1012, so that they penetrate through the supporting member 300, and the projected portions are fused to fix the supporting member 300 to the side surface. When a line L3 passing through the projection 1800 and perpendicular to the line L1, and a line L2 passing through the projection 1801 and perpendicular to the line L1, are drawn. The center of the supply opening 1200 is substantially on the line L3, the connection between the supply opening 1200 and a supply type 2200 is stabilized, and therefore, even if the cartridge falls, or even if a shock is imparted to the cartridge, the force applied to the connecting portion can be minimized. In addition, since the lines L2 and L3 are not overlapped, and since the projections 1800 and 1801 are disposed adjacent to that projection 1012 which is nearer to the ink ejection outlets of the ink jet head, the positioning of the ink jet unit relative to the ink container is further improved. In this Figure, a curve L4 indicates the position of the outer wall of the ink supply member 600 when it is mounted. Since the projections 1800 and 1801 are along the curve L4, the projections are effective to provide sufficient mechanical strength and positional accuracy against the weight of the end structure of the head IJH.

An end projection 2700 of the ink container IT is engageable with a hole formed in the front plate 4000 of the carriage to prevent the ink cartridge from being displaced extremely out of the position. A stopper 2101 is engageable with an unshown rod of the carriage HC, and when the cartridge IJC is correctly mounted with rotation, which will be described hereinafter, the stopper 2101 take a position below the rod, so that even if an upward force tending to disengage the cartridge from the correct position is unnecessarily applied, the correct mounted state is maintained. The ink container IT is covered with a cover 800 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 1700 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 600 through a supply opening 1200, the whole 320 of the supporting member 300 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure the hermetical seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, the accuracy in the assembling is improved, and is convenient in the mass-production. The number of parts is smaller than in conventional device, so that the good performance can be assured.

In this embodiment, as shown in FIGS. 2–4, the configuration after assembly is such that the top portion 603 of the ink supply member 600 cooperates with an end of the top thereof having the slits 1700, so as to form a slit S, as shown in FIG. 3. The bottom portion 604 cooperates with fed side end 4011 of a thin plate to which the bottom cover 800 of the ink container IT is bonded, so as to form a slit (not shown) similar to the slit S. The slits between the ink container IT and the ink supply member 600 are effective to enhance the heat radiation, and is also effective to prevent an expected pressure to the ink container IT from influencing directly the supply member or to the ink jet unit IJT.

The above-described various structures are individually effective to provide the respective advantages, and also they are most effective when they are combined each other.

(iii) Mounting of the Ink Jet Cartridge IJC to the Carriage HC

In FIG. 5, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 400 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 2011 corresponding to the pads 201 of the wiring board 200 of the ink jet cartridge IJC and a rubber pad sheet 4007 for producing elastic force for urging the backside of the flexible sheet 4005 to the pads 2001. The positioning hook 4001 functions to fix the ink jet cartridge IJC to the recording position. The front plate 4000 is provided with two positioning projection surfaces 4010 corresponding to the positioning projections 2500 and 2600 of the supporting member 300 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decreases from the plate roller side to the hook 4001 side. By this, the cartridge is inclined as shown in FIG. 5, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 2011 is determined. When the cartridge IJC is fixed at the recording position, the positioning surfaces are brought into contact with the surface of the supporting member 300. In this embodiment, the pads 201 of the supporting member 300 are distributed so that they are symmetrical with respect to the above-described line L1, and therefore, the amount of deformation of the respective projections of the rubber sheet 4007 are made uniform to stabilize the contact pressure of the pads 2011 and 201. In this embodiment, the pads 201 are arranged in two columns and upper and bottom two rows.

The hook 4001 is provided with an elongated hole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 5 to the position toward the platen side, and the positioning projections 2500 and 2600 come to the position where they are engageable to the positioning surfaces 4010. Then, the hook 4001 is moved leftwardly, so that the hook surface 4002 is contacted to the pawl 2100 of the cartridge IJC, and the ink cartridge IJC rotates about the contact between the positioning surface 2500 and the positioning projection 4010 in a horizontal plane, so that the pads 201 and 2011 are contacted to each other. When the hook 4001 is locked, that is retained at the fixing or locking position, by which the complete contacts are simultaneously established between the pads 201 and 2011, between the positioning portions 2500 and 4010, between the standing surface 4002 and the standing surface of the pawl and between the supporting member 300 and the positioning surface 4006, and therefore, the cartridge IJC is completely mounted on the carriage.

(iv) General Arrangement of the Apparatus

Figure 6:
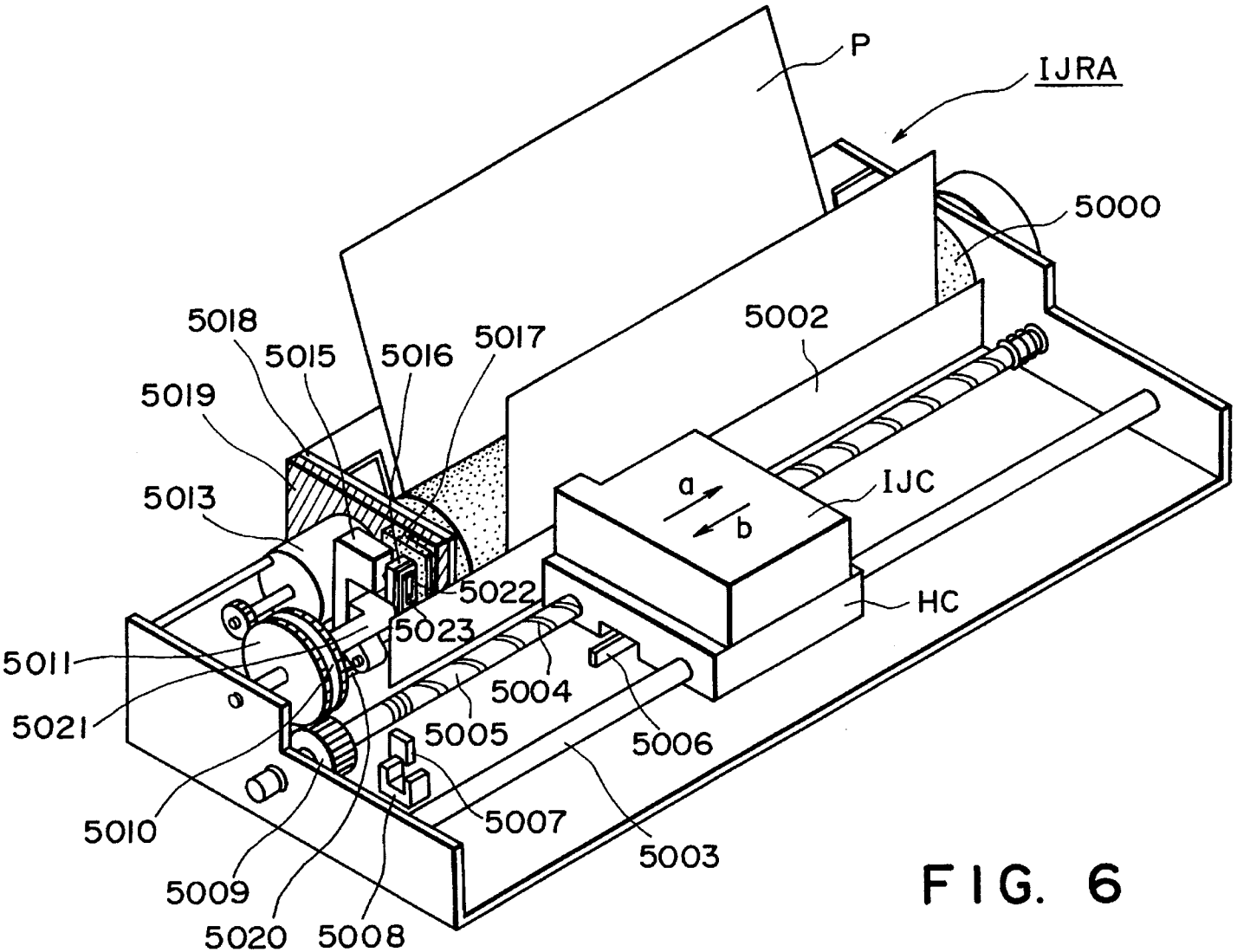
FIG. 6 is a perspective view of an ink jet apparatus according to an embodiment of the present invention.

FIG. 6 is a perspective view of an ink jet recording apparatus IJRA in which the present invention is used. A lead screw 5005 rotates by way of a drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

Figure 1:
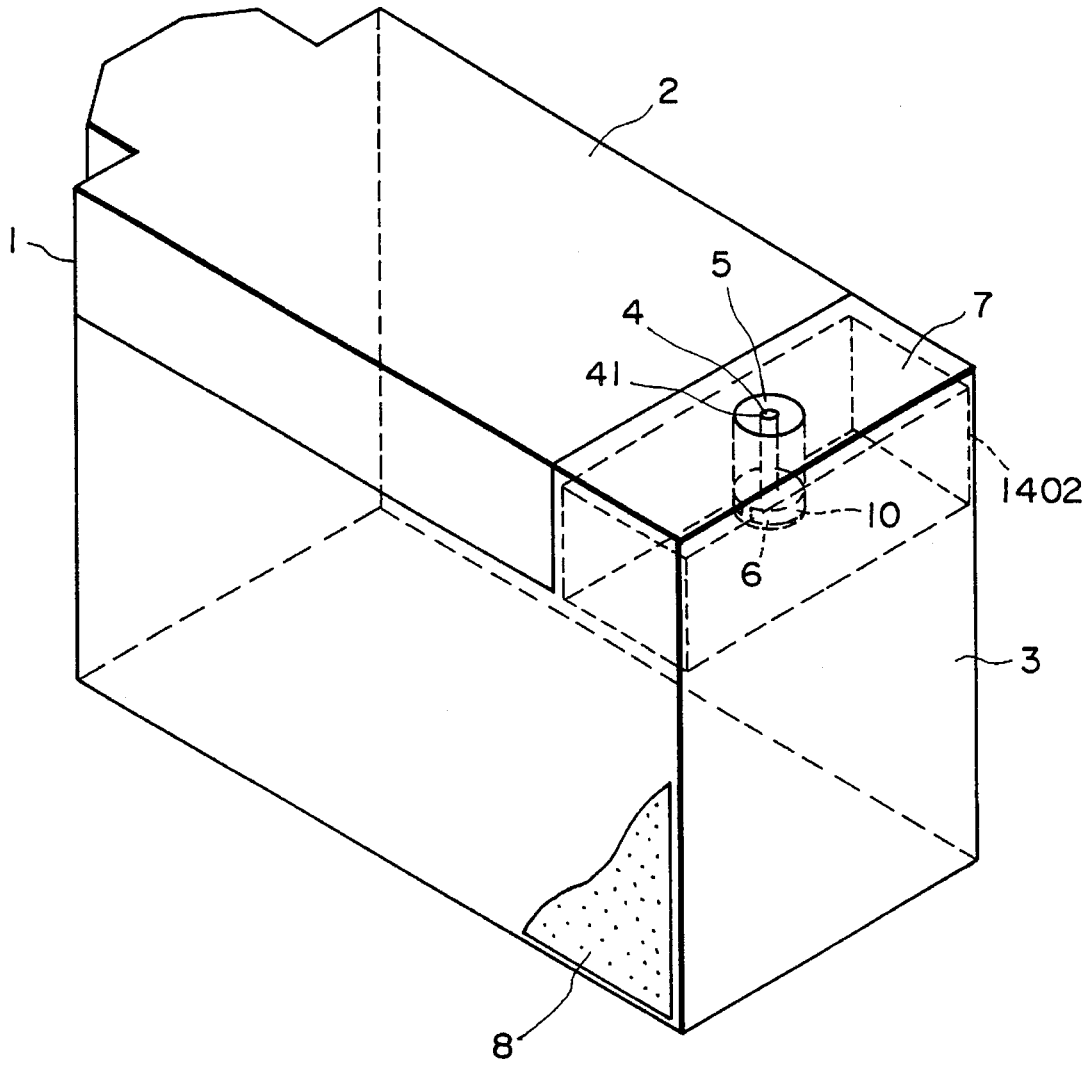
FIGS. 1 and 9 are perspective views of an ink jet recording cartridge according to an embodiment of the present invention.
Figure 7A:
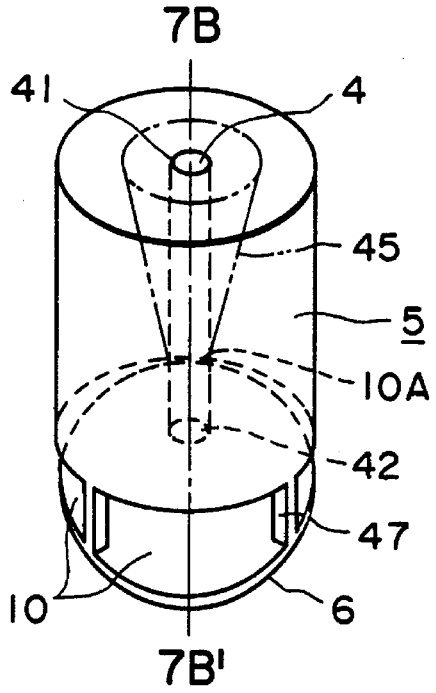
FIGS. 7A and 7B are a perspective view and a cross-section (taken along a line 7B–7B' of FIG. 7A) of a cap member according to an embodiment of the present invention.
Figure 7B:
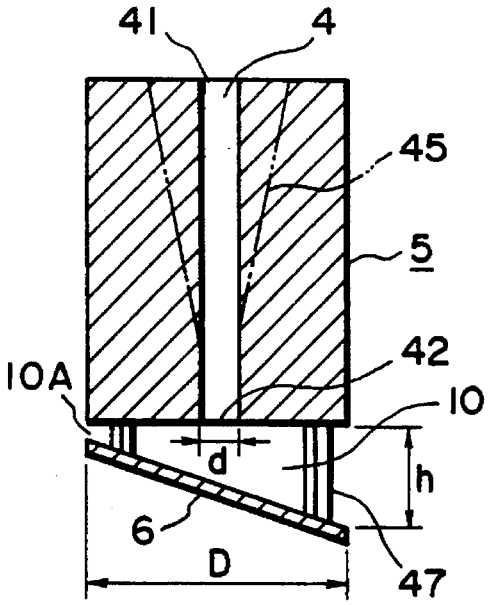

Referring to FIG. 1, there is shown a recording head cartridge according to an embodiment of the present invention. In this Figure, a reference numeral 2 designates a recording head for ejecting ink droplets in accordance with electric signals; 3 designates a container for containing the ink (recording liquid) to be supplied to the recording head 2; 4 designates an air vent to equalize the container internal pressure with the atmospheric pressure; 5 designates a cap member constituting a blocking plate 6 with the air vent 4; 7 designates a buffer chamber corresponding to the above-described atmospheric pressure supplying space 1402 to prevent ink leakage due to the temperature change or the pressure change; 8 designates a porous material retaining the recording liquid. The material of the blocking plate 6 includes glass, ceramic material, felt and plastic resin material. The plastic resin material includes polyamide, polyurethane, polyethylene (PE), polypropylene (PP), polymethyl methacrylate (PMMA), polystyrene (PS), polyvinylchloride (PVC), and ethylene vinylacetate copolymer (EVA). It is preferable that the cap member 5 is integrally formed of the plastic material with the blocking plate 6. Referring to FIGS. 7A and 7B, the blocking plate 6 has an area larger than an opening 42 of the air vent 4 at an end of the ink container to prevent direct communication between the opening 42 and the interior of the ink container, and is disposed between and away from the opening and the porous material 8. Thus, when the ink tends to release from the porous material to reach the opening 42 of the air vent 4, the blocking plate 6 blocks it, so that the ink does not directly reach the air vent 4. The air vent openings or spaces 10 are formed around the cap member 5 to provide indirect communication between the opening 42 and the interior of the ink container, and therefore, the venting and leakage preventing effects are remarkably better than the case of using an air venting pipe.

In this embodiment, the outside opening 41 and an inside opening 42 has the same diameter, so that the cross-sectional area of the pipe therebetween is uniform. It is preferable that the diameter of the opening 41 is made smaller than that of the opening 42 to further stabilize the venting communication. It is also preferable that as shown in FIGS. 7A and 7B by reference numeral (chain lines), it is also preferable that the pipe is in the form of a funnel having a taper. The angle thereof is preferably 45 degrees.

As will be understood from FIGS. 7A and 7B, in this embodiment, the air vent communicating openings 10 are formed by four connectors 47 connecting the surface including the opening 42 and the block plate 6 around the cap member 5, so that the opening 10 has a narrow portion 10A (0.2–0.5 mm approximately). Therefore, even if the ink deposited on the block plate 6 tends to enter the opening 10, the narrow linear opening 10 urges the ink away from the opening 42, that is, toward the narrow portion 10*a* by the capillary action, so that the leakage of the ink can be further prevented.

Figure 8A:
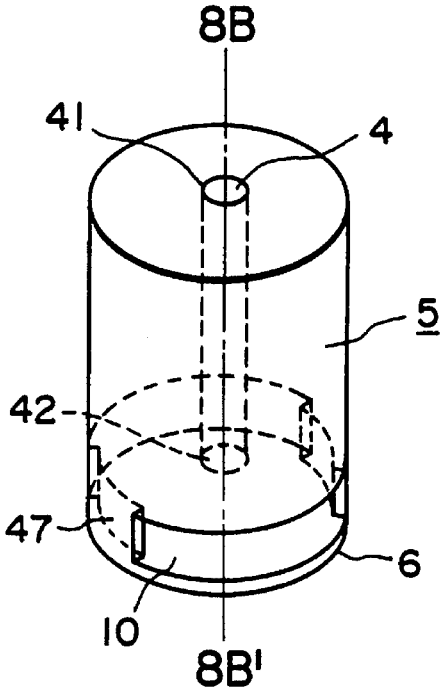
FIGS. 8A and 8B are a perspective view and a cross-sections (taken along a line 8B–8B' of FIG. 8A) of a cap member according to another embodiment of the present invention.
Figure 8B:
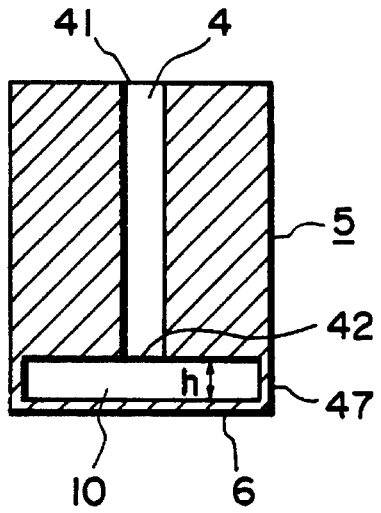

FIGS. 8A and 8B illustrates another embodiment. As contrasted to the embodiment of FIGS. 7A and 7B, the block plate 6 in this embodiment extends parallel to the surface in which the opening 42 is formed. The connectors 47 connecting the blocking plate 6 and the surface having the openings 42, as contrasted to the embodiment of FIGS. 7A and 7B, has a relatively long configuration, and they are provided at two diametrically opposite positions of the cap member 5.

This embodiment can provides substantially the same advantageous effects as of the FIGS. 7A and 7B embodiment.

A predetermined height h of the openings 10 in the direction of the venting communication (the direction of the length of the air vent 4), is preferably not less than 1 mm and not more than 3 mm, as will be understood from FIGS. 7B and 8B, in consideration of the entering of a relatively large ink droplet through the opening 10. It is preferable that the block plate 6 blocks the radius region (D/2) which is not less than 3.5 times the radius (d/2) of the opening 42. However, in the case of an exchangeable cartridge type, it blocks the radius area not less than twice.

In the embodiment of FIGS. 7A and 7B, the block plate 7 is inclined to prevent the recording liquid from being deposited on the air vent 4, and also to prevent the recording liquid remaining on the blocking plate 6. In this case, the blocking region by the blocking plate 6 is compared with the radius region of the opening 42 projected on a plane including the opening 42.

Figure 9:
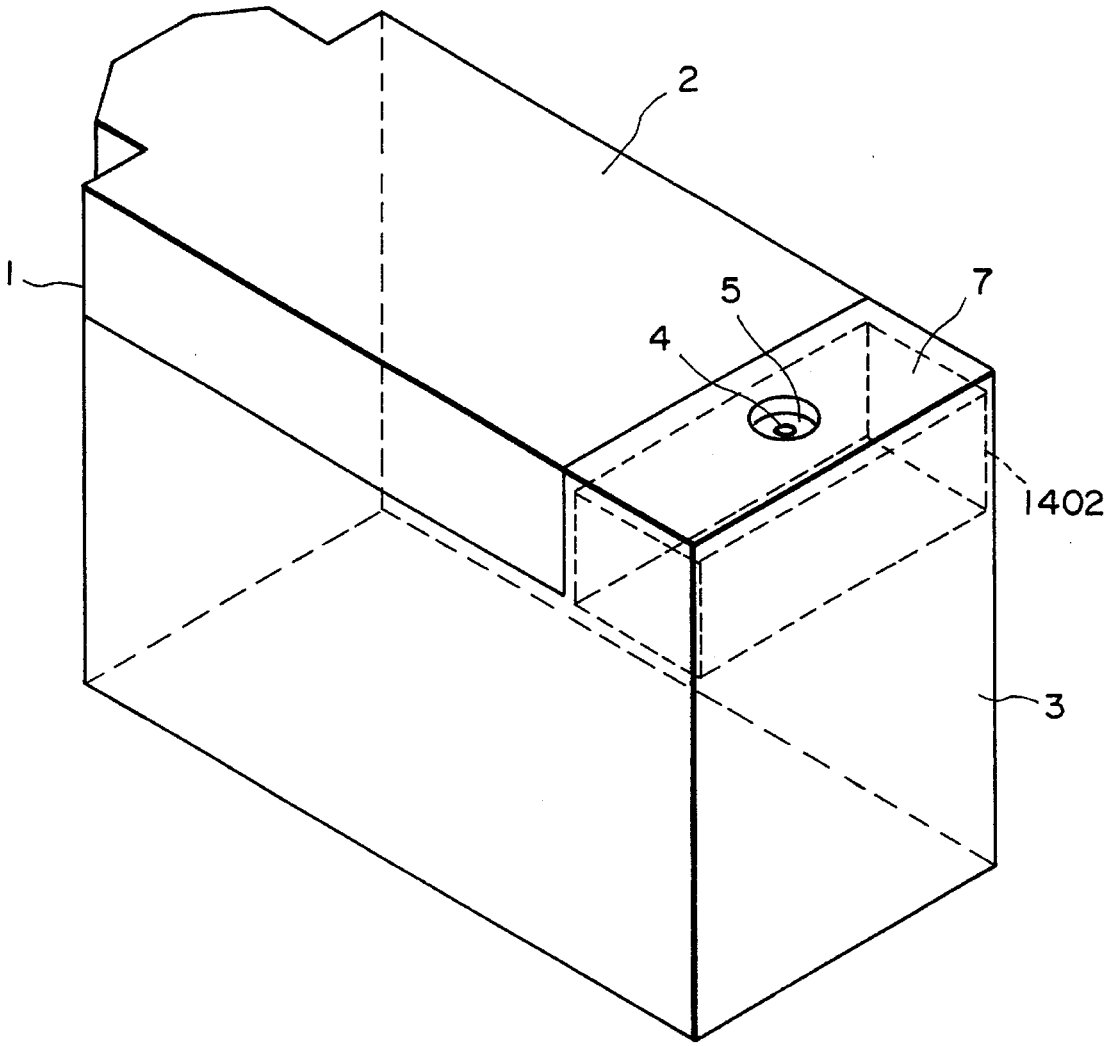

FIG. 9 illustrates a further embodiment of the ink jet cartridge having a cap 5 provided with the air vent opening 4 and the blocking plate 6. The cap 5, as will be understood from the Figure, is stepped back from a wall of the main body of the head cartridge. This is done, in order to protect user's hand or the like from directly contacting the ink even if the ink comes from the air vent 4 to the outside of the recording cartridge.

Figure 10:
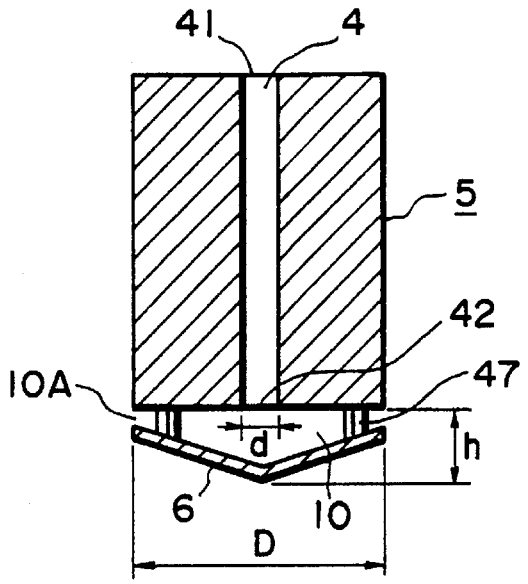
FIG. 10 is a sectional view of a cap member according to another embodiment of the present invention.

FIG. 10 shows another example of the cap member. The cap of this embodiment is different from that of FIGS. 7A and 7B in that the block plate 6 is bent at a line faced to the opening 42, so that a V-cross-section is constituted as shown in the Figure. The maximum height h of the air vent openings 10 in the direction of the length of the air vent 4 and the minimum thereof are preferably as described in conjunction with FIGS. 7A and 7B, more particularly, they are not less than 1 mm and not more than 3 mm, not less than 0.2 mm and not more than 0.5 mm, respectively.

The effects of this embodiment is similar to the embodiment of FIGS. 7A and 7B. More particularly, even if the ink is deposited on the blocking plate 6 and tends to reach the inside of the opening 10, the linear opening 10*a* urges the ink away from the opening 42 (toward the linear portion 10A) mainly by the capillary action, so that the ink leakage can be further prevented. Thus, the embodiment of FIG. 10 and FIGS. 7A and 7B, are such that the dimensions and configurations of the space between the opening 42 and the block 6 including the air vent openings 10 are so determined that the ink leakage can be effectively prevented. Adjacent the opening 42, the block plate 6 is disposed as far as possible from the opening 42, and the block plate is made closer to the surface of the opening 42 at a position or positions away from the opening 42, by which the ink leakage prevention is further assured.

FIGS. 11A, 11B, 11C and 11D show a further example of the cap member.

The configuration of various parts are similar to those of the embodiment of FIGS. 8A and 8B.

In this embodiment, the diameter of the opening 42 (0.8 mm in this embodiment) multiplies by 2 (0.8×2=1.6 mm)

and a distance (1.5 mm in this embodiment) between the insides of two connectors 47, are preferably not less than 1.1 mm and not more than 2.0 min. In addition, the former is larger than the latter. By doing so, even if the ink deposited on the blocking plate 6 to advanced to the inside of the openings 10, the ink is urged away from the opening 42 to the connecting portion 47 mainly by the capillary action, so that the ink leakage prevention effect is further enhanced.

Figure 11A:
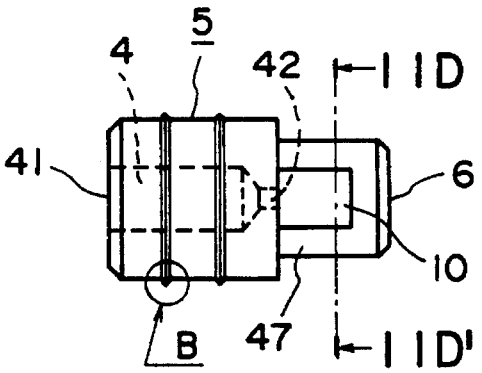
FIG. 11A is a side view of a cap member according to a further embodiment of the present invention.
Figure 11B:
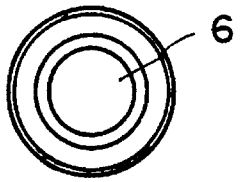
FIG. 11B is a bottom view of the cap member of FIG. 11A.
Figure 11C:
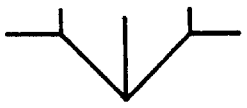
FIG. 11C is an enlarged view of a portion B in FIG. 11A.
Figure 11D:
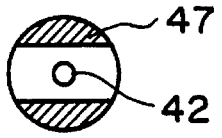
FIG. 11D is a sectional view taken along a line 11D–11D' of FIG. 11A.

Two projections shown in FIG. 11C are provided around the cap 5 and are effective to improve the sealing effect between the main body of the ink jet cartridge and the cap member 5 and are used to retain the cap member 5 at a proper position relative to the ink jet cartridge when the cap member 5 is engaged into the main body of the ink jet cartridge. Then, the cap member 5 is maintained out of contact with the ink absorbing material 8 of porous material. Thus, various advantageous effects described above can be provided. Although not mentioned with respect to the foregoing embodiments, unshown means is provided to retain the cap member 5 relative to the ink cartridge.

As will be understood from FIG. 11A, in order to further stabilize the communication with the atmosphere, the air venting bore 4 is expanded toward the atmosphere side.

Substantially the same advantageous effects were provided as in the foregoing examples.

In the foregoing embodiments, the cap member including the block plate was made of nylon 11 PMN0 P40 (available from Toray Kabushiki Kaisha, Japan) as an integrally molded element.

The cap member indicated by a reference 5 in FIG. 1, and indicated by a reference 1400 in FIG. 2, is inserted through a side wall of the main body of the ink jet head cartridge, as will best shown in FIG. 2. As shown in FIGS. 5 and 6, the ink jet head cartridge is mounted on a carriage, and usually, it reciprocates in a direction substantially perpendicular to the vertical direction. It is preferable that the cap member is in such a position that the air venting bore 4 extends substantially perpendicular to the vertical direction particularly the movement direction of the carriage from the standpoint of further preventing the ink leakage by the block plate.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond the nucleate boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

As described in the foregoing, the present invention uses a blocking plate without blocking the air venting hole adjacent the container side opening of the air venting bore. Accordingly, the recording liquid in the container is prevented from leaking out through the venting bore even upon impact thereto or vibration thereof.

While the invention has been described with reference to the structures disclosed herein, it is not confined to the details set forth and this application is intended to cover such modifications or changes as may come within the purposes of the improvements or the scope of the following claims.

What is claimed is:

1. A recording head cartridge comprising:

a recording head for ejecting recording liquid;

a container having therein a porous material for containing the recording liquid and an air supply space, said ink container being connected to said recording head for supplying the recording liquid thereto;

communicating means having an inside opening for substantially balancing pressure in said container with an ambient pressure;

a blocking plate disposed in said air supply space of said container and adjacent to and facing said inside opening and said porous material for preventing direct communication between the interior of said container and said inside opening, said blocking plate being out of contact with said porous material; and connectors supporting said blocking plate relative to said communicating means with a predetermined distance between said blocking plate and said communicating means, wherein said connectors provide a space therebetween and an opening not facing said porous material for indirectly communicating along said blocking plate said air supply space with said inside opening.

2. A cartridge according to claim 1, wherein said blocking plate is slanted relative to a plane including said inside opening.

3. A cartridge according to claim 2, wherein said blocking plate is bent at a line including a portion facing said inside opening such that said blocking plate has a V-shaped cross-section.

4. A cartridge according to claim 2, wherein said communicating means is relatively elongated, and said predetermined distance, measured in a longitudinal direction of said communicating means, has a minimum dimension at a position spaced from said inside opening.

5. A cartridge according to claim 2, wherein said communicating means is relatively elongated, and said predetermined distance, measured in a longitudinal direction of said communicating means, has a maximum dimension of not less than 1 mm and more than 3 mm.

6. A cartridge according to claim 2, wherein said communicating means is relatively elongated, and said predetermined distance, measured in a longitudinal direction of said communicating means, has a minimum dimension not less than 0.2 mm and not more than 0.5 mm.

7. A cartridge according to claim 2, wherein said communicating means is relatively elongated, and said predetermined distance, measured in a longitudinal direction of said communicating means, has a minimum dimension small enough to cause capillary action.

8. A cartridge according to claim 1, wherein said blocking plate is a flat plate.

9. A cartridge according to claim 8, wherein said blocking plate extends substantially parallel to a plane including said inside opening.

10. A cartridge according to claim 9, wherein twice a diameter of said inside opening is larger than a distance between facing surfaces of said connectors.

11. A cartridge according to claim 1, wherein said communicating means includes a member defining a venting bore having opposite ends, wherein an outside opening thereof is larger than said inside opening.

12. A cartridge according to claim 11, wherein said bore is tapered.

13. A cartridge according to claim 1, wherein said communicating means is below a surface of a wall of said cartridge.

14. A cartridge according to claim 1, wherein said blocking plate is of glass, ceramic material, felt or plastic material.

15. A cartridge according to claim 1, wherein said communicating means, said blocking plate and said connectors are integrally molded of polyurethane, polyethylene, polypropylene, polymethyl methacrylate, polystyrene, polyvinyl chloride or ethylenevinylacetate copolymer.

16. A cartridge according to claim 1, wherein said communicating means, said blocking plate and said connectors are integrally molded with polyamide material.

17. An ink container comprising:

an interior space having therein an absorbing material for retaining ink and an air supply space;

a communicating bore having an inside opening for balancing pressure in said interior space with an ambient pressure;

a blocking plate disposed in said air supply space of said container and adjacent to and facing said inside opening and said absorbing material for preventing direct communication between said interior space of said container and said inside opening; and connectors supporting said blocking plate relative to said communicating bore with a predetermined distance between said blocking plate and said communicating bore, wherein said connectors provide a space therebetween and an opening not facing said absorbing material for indirectly communicating along said blocking plate said air supply space with said inside opening.

18. A capping member comprising:

a member having a communicating bore with an inside opening for balancing pressure in a container with an ambient pressure;

a blocking plate for disposition in an air supply space of said container and adjacent to and facing said inside opening and a porous material in said container for preventing direct communication between the interior of the container and said inside opening; and connectors connecting said member relative to said blocking plate with a predetermined distance between said blocking plate and said member, wherein said connectors provide a space therebetween and an opening arranged for disposition not facing the porous material to indirectly communicate along said blocking plate the air supply space of the container with said inside opening.

19. An ink jet recording apparatus comprising:

a carriage; and a recording head cartridge mounted on said carriage and including:

a recording head for ejecting recording liquid, a container having therein a porous material for containing the recording liquid and an air supply space, said ink container being connected to said recording head for supplying the recording liquid thereto, communicating means with an inside opening for substantially balancing pressure in said container with an ambient pressure, a blocking plate disposed in said air supply space of said container and adjacent to and facing said inside opening and said porous material for preventing direct communication between the interior of said container and said inside opening, said blocking plate being out of contact with said porous material, and connectors supporting said blocking plate relative to said communicating means with a predetermined distance between said blocking plate and said communicating means, wherein said connectors provide a space therebetween and an opening not facing said porous material for indirectly communicating along said blocking plate said air supply space with said inside opening;

wherein said recording head cartridge is mounted on said carriage such that said communicating means extends in a substantially horizontal direction.

20. An ink jet apparatus according to claim 19, wherein said communicating means extends along a movement direction of said carriage.

21. An ink jet recording apparatus comprising:

a carriage; and a recording head cartridge mounted on said carriage and including:

a recording head for ejecting recording liquid, a container having therein a porous material for containing the recording liquid and an air supply space, said ink container being connected to said recording head for supplying the recording liquid thereto, communicating means having an inside opening for substantially balancing pressure in said container with an ambient pressure, a blocking plate disposed in said air supply space of said container and adjacent to and facing said inside opening and said porous material for preventing direct communication between the interior of said container and said inside opening, and said blocking plate being out of contact with said porous material, and connectors supporting said blocking plate relative to said communicating means with a predetermined distance between said blocking plate and said communicating means, wherein said connectors provide a space therebetween and an opening not facing said porous material for indirectly communicating along said blocking plate said air supply space with said inside opening.

22. An ink jet recording apparatus comprising:

a recording head for ejecting recording liquid;

a container for containing the recording liquid, said container being connected to said recording head for supplying the recording liquid thereto; and a capping member in said container and including:

a member having a communicating bore with an inside opening for balancing pressure in said container with an ambient pressure, a blocking plate disposed in an air supply space of said container and adjacent to and facing said inside opening and a porous material in said container for preventing direct communication between the interior of said container and said inside opening, and connectors connecting said member relative to said blocking plate with a predetermined distance between said blocking plate and said member, wherein said connectors provide a space therebetween and an opening not facing said porous material for indirectly communicating along said blocking plate said air supply space of the container with said inside opening.

23. A cartridge according to claim 22, wherein a periphery of said capping member is provided with a projection around said capping member.

24. An ink jet recording apparatus comprising:

a carriage; and a recording head cartridge mounted on said carriage and having a recording head for ejecting recording liquid, a container for containing the recording liquid, said container being connected to said recording head for supplying the recording liquid thereto, and a capping member in said container, said capping member including:

a member having a communicating bore with an inside opening for balancing pressure in said container with an ambient pressure, a blocking plate disposed in an air supply space of said container and adjacent to and facing said inside opening and a porous material in said container for preventing direct communication between the interior of said container and said inside opening, and connectors connecting said member relative to said blocking plate with a predetermined distance between said blocking plate and said member, wherein said connectors provide a space therebetween and an opening not facing said porous material for indirectly communicating along said blocking plate said air supply space said inside opening.

* * * * *

UNITED STATES PATENT AND TRADEMARK OFFICE

CERTIFICATE OF CORRECTION

PATENT NO. : 5,500,666

DATED : March 19, 1996

INVENTORS : YOSHIFUMI HATTORI ET AL.

It is certified that error appears in the above-identified patent and that said Letters Patent is hereby corrected as shown below:

COLUMN 1

Line 40, "above" should read --above- --;
Line 41, "been" should read --been made--.

COLUMN 2

Line 34, "heat" should read --head--;
Line 49, "contain" should read --contains--.

COLUMN 4

Line 59, "port 1400" should read --port 1401--;
Line 60, "material 1400" should read --material--;
Line 61, "port 1400" should read --port 1401--.

COLUMN 5

Line 6, "with" should read --with a--;

UNITED STATES PATENT AND TRADEMARK OFFICE

CERTIFICATE OF CORRECTION

PATENT NO. : 5,500,666

DATED : March 19, 1996

INVENTORS : YOSHIFUMI HATTORI ET AL.

It is certified that error appears in the above-identified patent and that said Letters Patent is hereby corrected as shown below:

COLUMN 5

Line 7, "an" should be deleted; "provisions" should read --provision--;
Line 8, "the ribs" should read --ribs--; "corner." should read --corner may be preferable.--;
Line 34, "1401." should read --1401 is provided.--;
Line 46, "saved." should read --prevented.--;
Line 53, "the parallel" should read --parallel--.

COLUMN 6

Line 8, "drawn. The" should read --drawn, the--;
Line 11, "type" should read --pipe--;
Line 30, "take" should read --takes--;
Line 54, "whole" should read --hole--.

COLUMN 7

Line 17, "is" should read --are--;
Line 22, "combined" should read --combined with--;

UNITED STATES PATENT AND TRADEMARK OFFICE

CERTIFICATE OF CORRECTION

PATENT NO. : 5,500,666

DATED : March 19, 1996

INVENTORS : YOSHIFUMI HATTORI ET AL.

It is certified that error appears in the above-identified patent and that said Letters Patent is hereby corrected as shown below:

COLUMN 7

Line 32, "400" should read --4000--;
Line 63, "4010 by" should read --4010. By--.

COLUMN 9

Line 42, "the ink" should read --the air vent space of the of the ink--;
Line 46, "has" should read --have--;
Line 62, "10a" should read --10A--;
Line 66, "illustrates" should read --illustrate--.

COLUMN 10

Line 4, "openings" should read --opening--;
Line 7, "provided" should read --provide--;
Line 21, "7" should read --6--;

UNITED STATES PATENT AND TRADEMARK OFFICE

CERTIFICATE OF CORRECTION

PATENT NO. : 5,500,666

DATED : March 19, 1996

INVENTORS : YOSHIFUMI HATTORI ET AL.

It is certified that error appears in the above-identified patent and that said Letters Patent is hereby corrected as shown below:

COLUMN 10

Line 31, "done," should read --done--;
Line 45, "is" should read --are--;
Line 48, "10a" should read --10A--;
Line 51, "embodiment" should read --embodiments--.

COLUMN 11

Line 3, "2.0 min." should read --2.0 mm.--;
Line 5, "to advanced" should read --is advanced--;
Line 33, "will best" should be deleted;
Line 48, "of" should read --is --;
Line 52, "system" should read --system;--;
Line 58, "provide" should read --provided--.

UNITED STATES PATENT AND TRADEMARK OFFICE

CERTIFICATE OF CORRECTION

PATENT NO. : 5,500,666

DATED : March 19, 1996

INVENTORS : YOSHIFUMI HATTORI ET AL.

It is certified that error appears in the above-identified patent and that said Letters Patent is hereby corrected as shown below:

COLUMN 12

Line 50, "multi-color" should read --multi-color mode--.

COLUMN 13

Line 35, "ink" should be deleted.

COLUMN 14

Line 3, "more" should read --not more--.

COLUMN 15

Line 16, "ink" should be deleted;
Line 38, "apparatus" should read --recording apparatus--;
Line 49, "ink" should be deleted.

UNITED STATES PATENT AND TRADEMARK OFFICE

CERTIFICATE OF CORRECTION

PATENT NO. : 5,500,666

DATED : March 19, 1996

INVENTORS : YOSHIFUMI HATTORI ET AL.

It is certified that error appears in the above-identified patent and that said Letters Patent is hereby corrected as shown below:

COLUMN 16

Line 8, "An ink jet recording apparatus" should read --A recording head cartridge--;
Line 33, "apparatus" should read --head--;
Line 57, "space said" should read --space with said--.

Signed and Sealed this

Eighth Day of October, 1996

Bruce Lehman

*Attest:*

BRUCE LEHMAN

*Attesting Officer*

*Commissioner of Patents and Trademarks*